US010494820B1

(12) United States Patent
Chen

(10) Patent No.: US 10,494,820 B1
(45) Date of Patent: Dec. 3, 2019

(54) CONNECTOR OF SYSTEMATIC BOARD OF BUILDING

(71) Applicants: SHAN YEUN CO,. LTD., Yilan County (TW); 2145677 Alberta Ltd., Edmonton (CA)

(72) Inventor: Wen-Chi Chen, Yilan County (TW)

(73) Assignees: SHAN YEUN CO., LTD., Yilan County (TW); 2145677 ALBERTA LTD., Edmonton, AB (CA)

( * ) Notice: Subject to any disclaimer, the term of this patent is extended or adjusted under 35 U.S.C. 154(b) by 0 days.

(21) Appl. No.: 16/224,814

(22) Filed: Dec. 19, 2018

(30) Foreign Application Priority Data

Nov. 2, 2018 (TW) ..... 107139063 A

(51) Int. Cl.
*E04F 15/02* (2006.01)
*E04F 13/08* (2006.01)

(52) U.S. Cl.
CPC .... *E04F 15/02038* (2013.01); *E04F 13/0826* (2013.01); *E04F 15/02005* (2013.01); *E04F 15/02044* (2013.01); *E04F 2015/02077* (2013.01); *E04F 2015/02094* (2013.01); *E04F 2201/0547* (2013.01)

(58) Field of Classification Search
CPC ..... E04F 15/02005; E04F 15/02022; E04F 15/02038; E04F 15/02044; E04F 15/02183; E04F 2015/02077; E04F 2015/02094; E04F 2015/02122; E04F 2201/0523; E04F 2201/0541; E04F 2201/0547; E04F 2201/05; E04F 13/0826
USPC ..... 52/483.1, 489.1, 489.2
See application file for complete search history.

(56) References Cited

U.S. PATENT DOCUMENTS 6,647,638 B1 * 11/2003 Doyal ..... E04B 5/12 33/613
2003/0121226 A1 * 7/2003 Bolduc ..... E04F 15/04 52/391
2003/0154662 A1 * 8/2003 Bruchu ..... E04F 15/10 52/87
2008/0222993 A1 * 9/2008 Prichard ..... E04F 15/02005 52/702

(Continued)

FOREIGN PATENT DOCUMENTS

CA 2947656 A1 * 11/2015
DE 202014105889 U1 * 1/2015

(Continued)

*Primary Examiner* — Ryan D Kwiecinski
(74) *Attorney, Agent, or Firm* — Leong C. Lei

(57) ABSTRACT

A connector is provided for jointing two boards to have the boards mounted to and lapping over a beam. The connector has one side that is formed with an engagement slot for jointing one board and an opposite side formed with a mortise trough for jointing another board. The connector also includes a path-following hole penetrating therethrough in an up-down direction and a track channel formed in a bottom of the connector and having an opening facing downward. The engagement slot and the mortise trough have axial directions that are perpendicular to an axial direction of the track channel. The path-following hole has a bottom opening located in the center of the track channel. The connector is adjustable of the position thereof through sliding along the beam by means of the track channel for limited axial movement.

17 Claims, 10 Drawing Sheets

(56) References Cited

U.S. PATENT DOCUMENTS

| | | | | |
|---|---|---|---|---|
| 2009/0019805 | A1* | 1/2009 | Zanelli | E04F 15/02 52/489.1 |
| 2013/0014465 | A1* | 1/2013 | Kilgore | E04F 15/02044 52/650.3 |
| 2015/0047278 | A1* | 2/2015 | Blount | E04F 15/08 52/223.6 |
| 2015/0096256 | A1* | 4/2015 | Lam | E04F 15/02044 52/582.1 |
| 2016/0146237 | A1* | 5/2016 | Tomatsu | F16B 37/005 403/13 |
| 2017/0037643 | A1* | 2/2017 | Mitchell | E04F 15/02044 |
| 2019/0055974 | A1* | 2/2019 | Vandenberg | F16B 12/2063 |

FOREIGN PATENT DOCUMENTS

| | | | | |
|---|---|---|---|---|
| WO | WO-2013134119 | A2 * | 9/2013 | |
| WO | WO-2018111168 | A1 * | 6/2018 | E04F 15/02044 |

* cited by examiner

CONNECTOR OF SYSTEMATIC BOARD OF BUILDING

(A) TECHNICAL FIELD OF THE INVENTION

The present invention relates generally to the field of systematic board decoration (such as floor boards, wall boards, and partition boards) of buildings, and more particularly to a novel technique for quickly mounting two adjacent boards to a beam.

(B) DESCRIPTION OF THE PRIOR ART

Heretofore, in making systematic boards for decorative floor boards, wall boards, or partition boards, it is commonplace to joint two adjacent boards to a beam with connectors. Prior art techniques are disclosed in for example US2007805902, US20030154662, and US20050257473. These known techniques of the patents suffer the following drawbacks:

(1) In an operation of construction, it is necessary for an operator to use one hand to correct the position of a connector in order to align with a center of a beam, while simultaneously pushing the connector to securely fit into and fix a board, and to use another hand to operate a screwdriver. This often leads frequent adjustment of the position of the connector mounted to the beam. It is known that various factors, such as haste, carelessness, inadvertence, emotional instability, and poor skillfulness, may cause undesired positional shifting of the fastening position of the connector, leading to ineffectiveness of transfer of stress through the connector to the beam when the board bears an external force. Thus, poor construction quality may occasionally result and overall construction performance cannot be increased, making it difficult for improving economic benefits. This is one of the shortcomings that the known technique cannot overcome.

(2) When boards mounted with the known techniques are acted upon by impact forces or jerk forces, since a contact area between the boards and connectors is limited, stability of the boards that bear the forces may be poor due to reduction of the contact area, leading to noise and vibration. This cannot be further improved.

(3) There is a gap around 6.4 mm present between two adjacent boards after the boards are fastened by the connectors. These known connectors have no specific structural design to reduce such a gap. As such, decoration so built, as a whole, cannot be made more delicate and better looking. In addition, such a gap may have dust or tiny debris deposited therein, leading to difficulty of cleaning.

(4) The connector is fastened to the beam with screws. The heads of the screws are located in such a gap. To eliminate undesired color conflict between the screw heads and the systematic boards, the screw heads are often treated with electroplating or blackening in advance. The quantity of screws used is quite large and this would cause troubles in further reducing the cost.

SUMMARY OF THE INVENTION

The primary objective of the present invention is to provide a connector of a systematic board of a building, which allows two boards to lap over and joint to a beam, and comprises at least:

a path-following hole completely penetrating through the connector in an up-down direction; and a track channel, which has an opening facing downward and is formed in a bottom of the connector to allow the connector to slide along the beam in an axial direction by means of the track channel for limited movement for positional adjustment, the path-following hole being arranged to have a bottom opening located in a central portion of the track channel so as to allow a screw to extend through the path-following hole for fastening the connector to a center of the beam.

As such, the operation that is frequently carried out in the prior art for connecting the position of the connector can be eliminated and the problem of the prior art that the connector may suffer positional shifting during the process of being fastened to a beam can be overcome.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Referring to FIGS. 1-10, the present invention provides a connector of a systematic board of a building, the term "systematic board" refers generally to a floor board, a wall board, or a partition board, and the likes. The systematic board assembly comprises a connector 10, a screw 20 and at least two boards 30, 30A. The aforementioned connector 10 functions to join the two boards 30, 30A by having the boards 30, 30A mounted to and lapping over a beam A.

Figure 4:
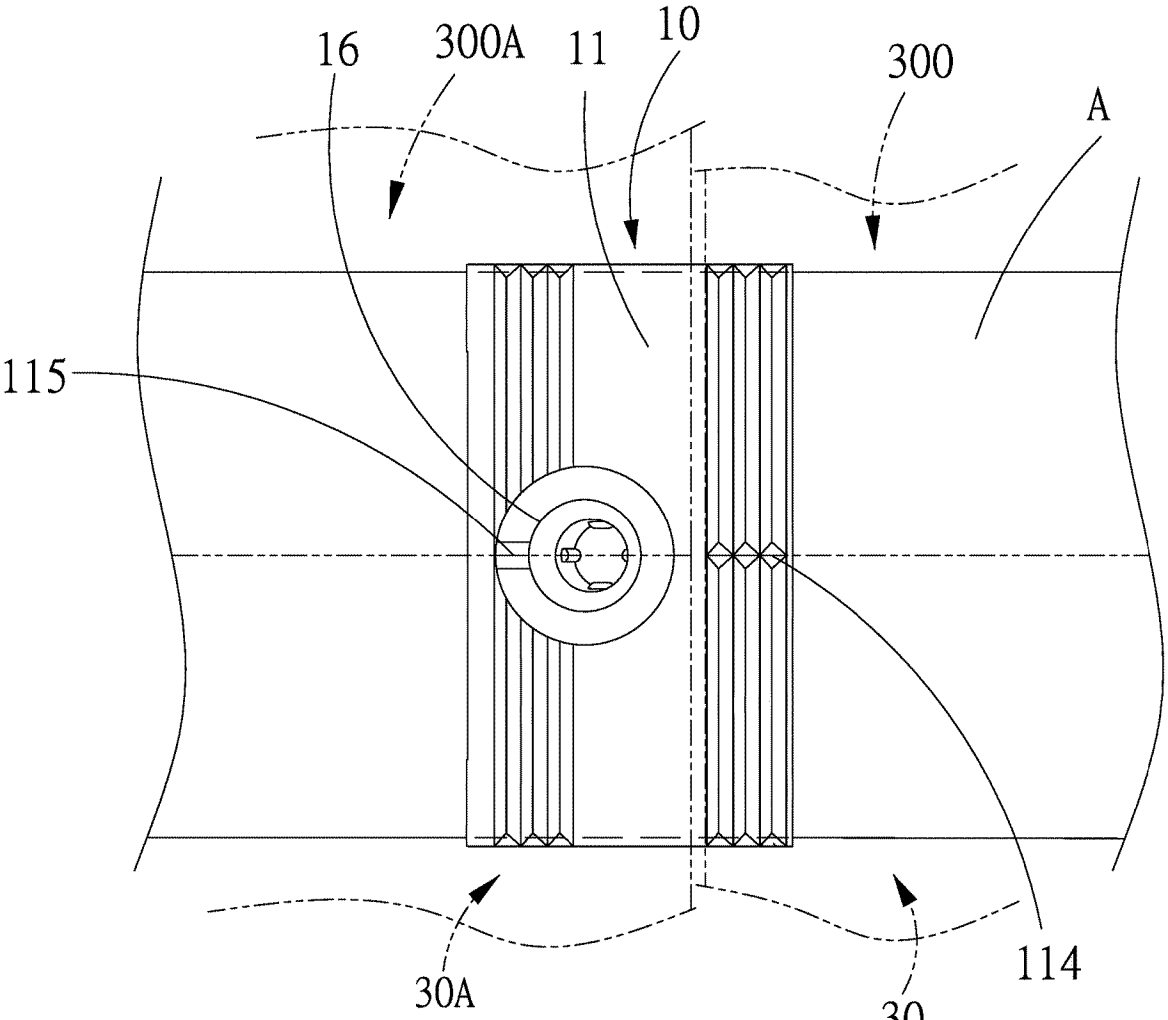
FIG. 4 is a top plan view, in an assembled form, showing the present invention in part.
Figure 5:
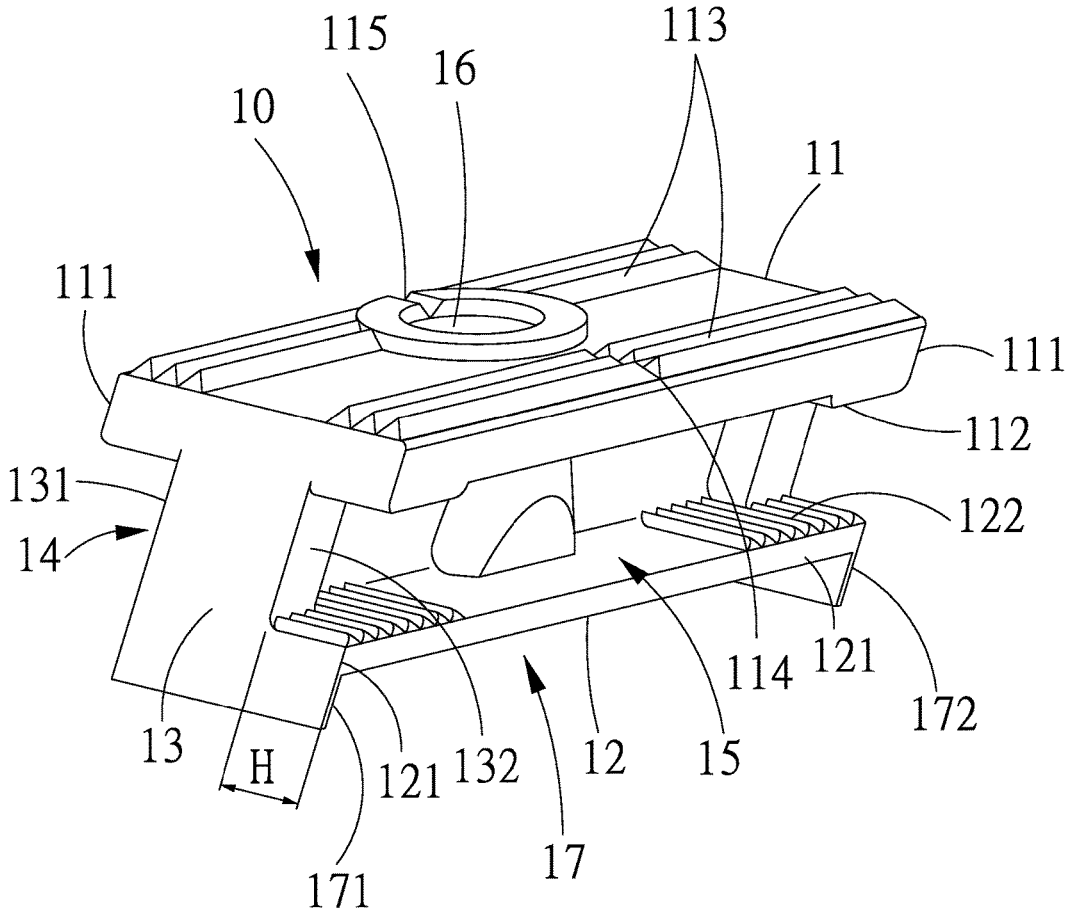
FIG. 5 is a perspective view showing a connector according to the present invention.
Figure 6:
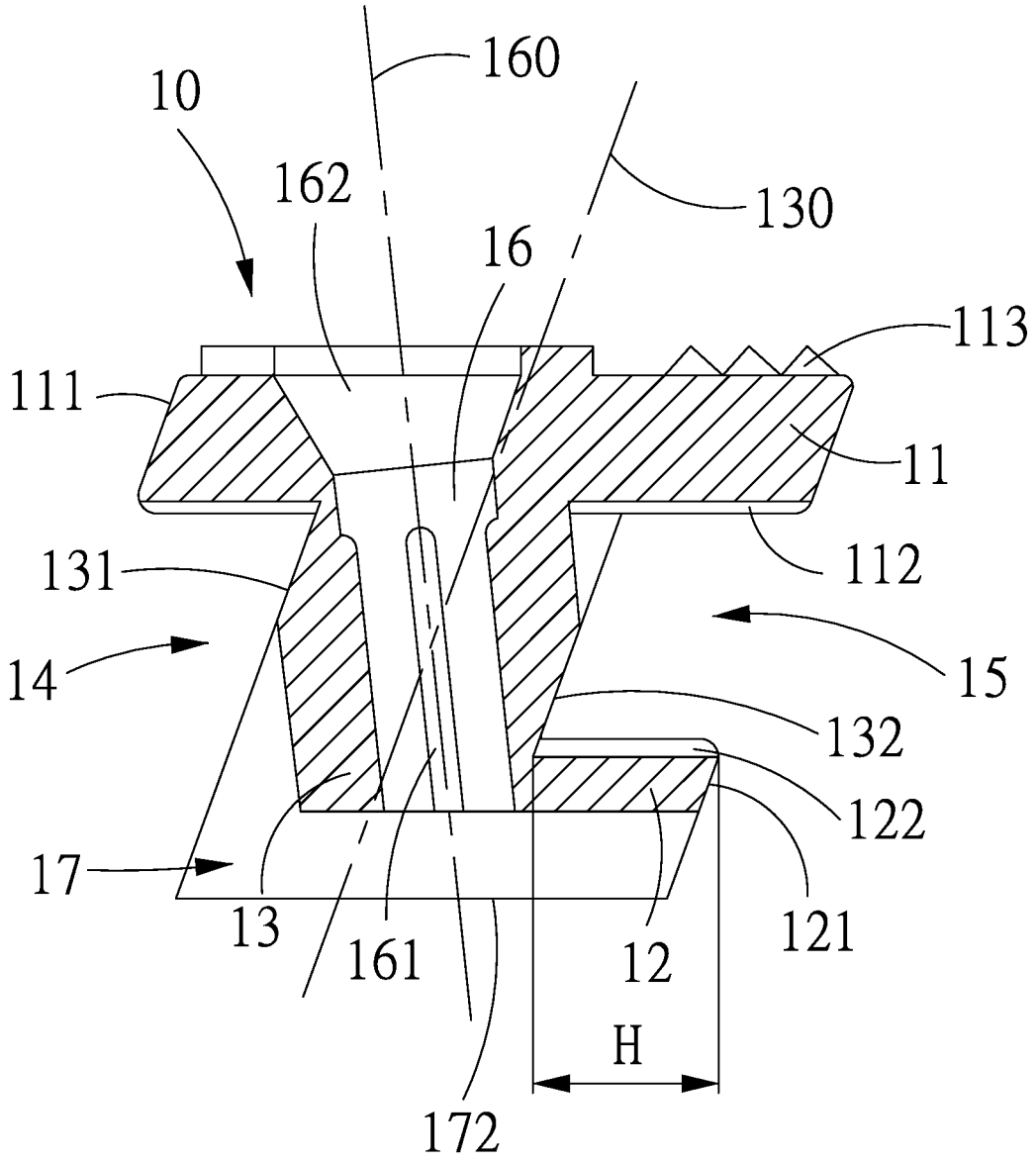
FIG. 6 is a cross-sectional view showing the connector t according to the present invention.
Figure 8:
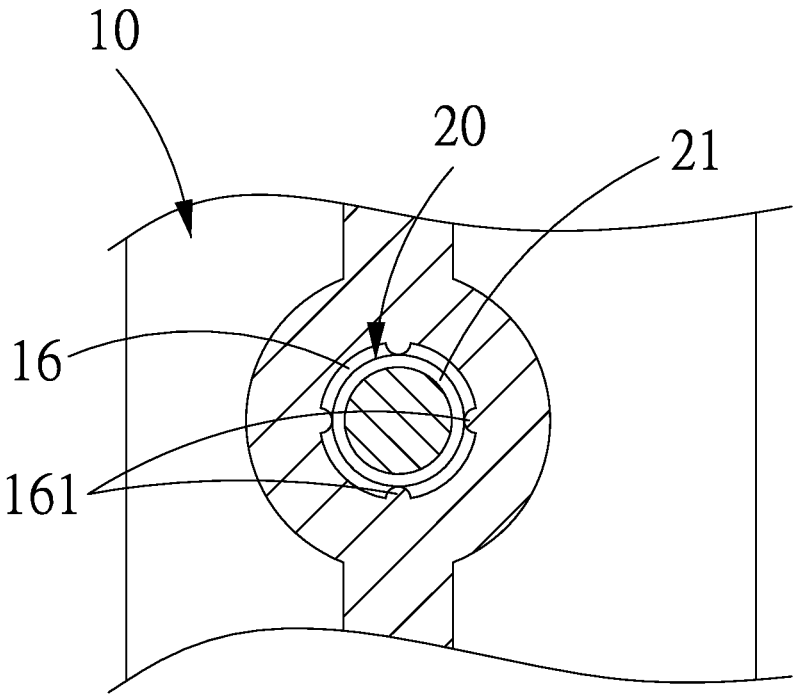
FIG. 8 is a horizontal cross-sectional view showing the connector of the present invention in combination with the screw.

Referring to FIGS. 1-6, the aforementioned connector 10 is provided for mounting to a wood beam A of a floor or a wall and generally comprises: an upper plate 11, a lower plate 12, and an intermediate block 13 bridging between and connected to the upper plate 11 and the lower plate 12. The upper plate 11 and the lower plate 12 are arranged parallel and have the same length. The aforementioned intermediate block 13 defines a center line 130 that extends in an inclined manner from the right upper side toward the left lower side as shown in the drawings. The intermediate block 13 has an upper end connected to around a middle part of the upper plate 11 and a lower end of the intermediate block 13 is connected to a left side of the lower plate 12 so that in a top plan view, a width H of the lower plate 12 is completely concealed under the upper plate 11. In addition, left and right sides of the upper plate 11 each form an upper slope surface 111 that matches the center line 130, and a right side of the lower plate 12 forms a lower slope surface 121 that matches the center line 130. The intermediate block 13 is formed, with the center line 130 as a center, a left taper surface 131 and a right taper surface 132 that are parallel to each other. The left taper surface 131 and a left part of the upper plate 11 define therebetween at least an engagement slot 14 having an opening facing leftward. The engagement slot 14 is of a configuration of a "7" shape. The right taper surface 132, a right part of the upper plate 11, and the lower plate 12 define therebetween a mortise trough 15 having an opening facing rightward. Further, the upper plate 11 is provided on a part thereof that is located at each of a front portion and a rear portion of the mortise trough 15 with a clamp section 112. The lower plate 12 is formed with first serration surfaces 122 respectively corresponding to the clamp sections 112. The first serration surfaces 122 are arranged to have teeth spaced from each other in a front-rear direction. A top of the upper plate 11 is provided with second serration surfaces 113 raised therefrom. The second serration surfaces 113 are each arranged to have teeth spaced from each other in a left-right direction, and thus, the first serration surfaces 122 are each perpendicular to each of the second serration surfaces 113. Further, the upper plate 11 is formed, in the top thereof, with a path-following hole 16 extending downward through the intermediate block 13 to provide guiding to a screw 20 that will be described later. The path-following hole 16 has a center axis 160 that extends in an inclined manner from the left upper side toward the right lower side as shown in the drawings, so that the center axis 160 and the center line 130 are generally arranged in an X-shape. The path-following hole 16 is provided, on an inside surface thereof, with a plurality of clamp ribs 161. In addition, the path-following hole 16 is formed, in an upper portion thereof, with a countersunk cavity 162 having a diameter that is gradually expanding in an upward direction. As shown in FIGS. 5 and 8, the present invention further provides a track channel 17 formed in a bottom of the connector 10 and having an opening facing downward to provide slidability along the beam A for a limited range of movement. The engagement slot 14 and the mortise trough 15 are arranged to have axial directions thereof perpendicular to an axial direction of the track channel 17. The path-following hole 16 has a bottom that is arranged at a central portion of the track channel 17. The track channel 17 is formed by a front stop 171 that extends downward from the front end of the aforementioned lower plate 12 and a rear stop 172 extending downward from the rear end of the lower plate 12, such that a spacing distance between the front stop 171 and the rear stop 172 is slightly larger than a width of the beam A to allow the connector 10 to slide along the beam A with the track channel 17 for limited axial movement to realize positional adjustment, with the bottom of the aforementioned path-following hole 16 being set at the central portion of the track channel 17 to allow the screw 20 that will be described later to penetrate through the path-following hole 16 to fasten the connector 10 to a center of the beam A.

Referring to FIGS. 1, 2, 3, 7, 8, and 9, the aforementioned screw 20 comprises a thread 21 and a screw head 22 connected to a top end of the thread 21. A lower portion of the thread 21 is set in tight engagement with the clamp ribs 161, so that the path-following hole 16 guides the thread 21 to screw downward to mount the aforementioned connector 10 to the beam A. Under such a condition, the screw head 22 of the screw 20 can be completely received in the countersunk cavity 162, while a bottom surface of the lower plate 12 is set on and abuts the beam A. Further, the aforementioned clamp ribs 161 may primarily function to clamp and hold the thread 21 in position before shipping outside of a fabrication workshop, in order to have the screw 20 and the connector 10 combined together as a unitary structure, without being readily separated from each, and to have the screw 20 guided to properly positioned, allowing a user to directly screw and fasten, thereby providing an effect of efficient and convenient operations of assembling.

Referring to FIGS. 1, 2, 3, and 10, the aforementioned board 30 has a cross-section having a rhombic shape, which comprises a first surface 31 and second surface 32 that are respectively arranged at upper and lower sides to be corresponding to each other and parallel to each other, and a left-side inclined surface 33 and a right-side inclined surface 34 that are respectively arranged at left and right sides to be parallel to and corresponding to each other. The aforementioned second surface 32 is positioned against and abuts the beam A. The left-side inclined surface 33 has a lower portion forming a left-side assembling structure. The left-side assembling structure is formed of a first groove 331 that mates the right part of the upper plate 11, a second groove 332 that mates the lower plate 12, and a first tenon block 333 that mates the mortise trough 15. The right-side inclined surface 34 has a lower portion forming a right-side assembling structure. The right-side assembling structure is formed of a third groove 341 that mate the left part of the upper plate 11 and a second tenon block 342 that mates the engagement slot 14.

Figure 1:
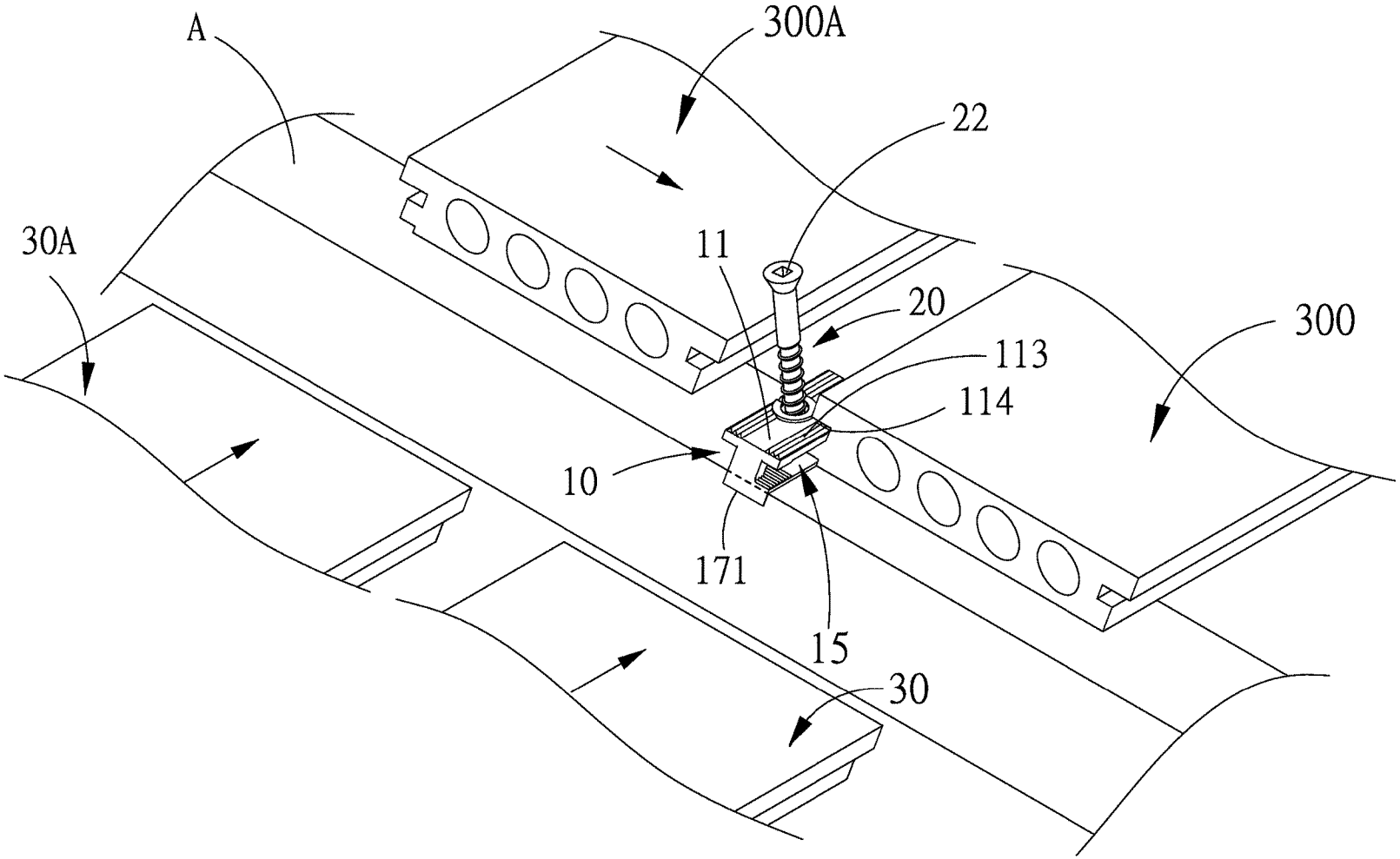
FIG. 1 is a perspective view, in an exploded form, showing the present invention in part.
Figure 2:
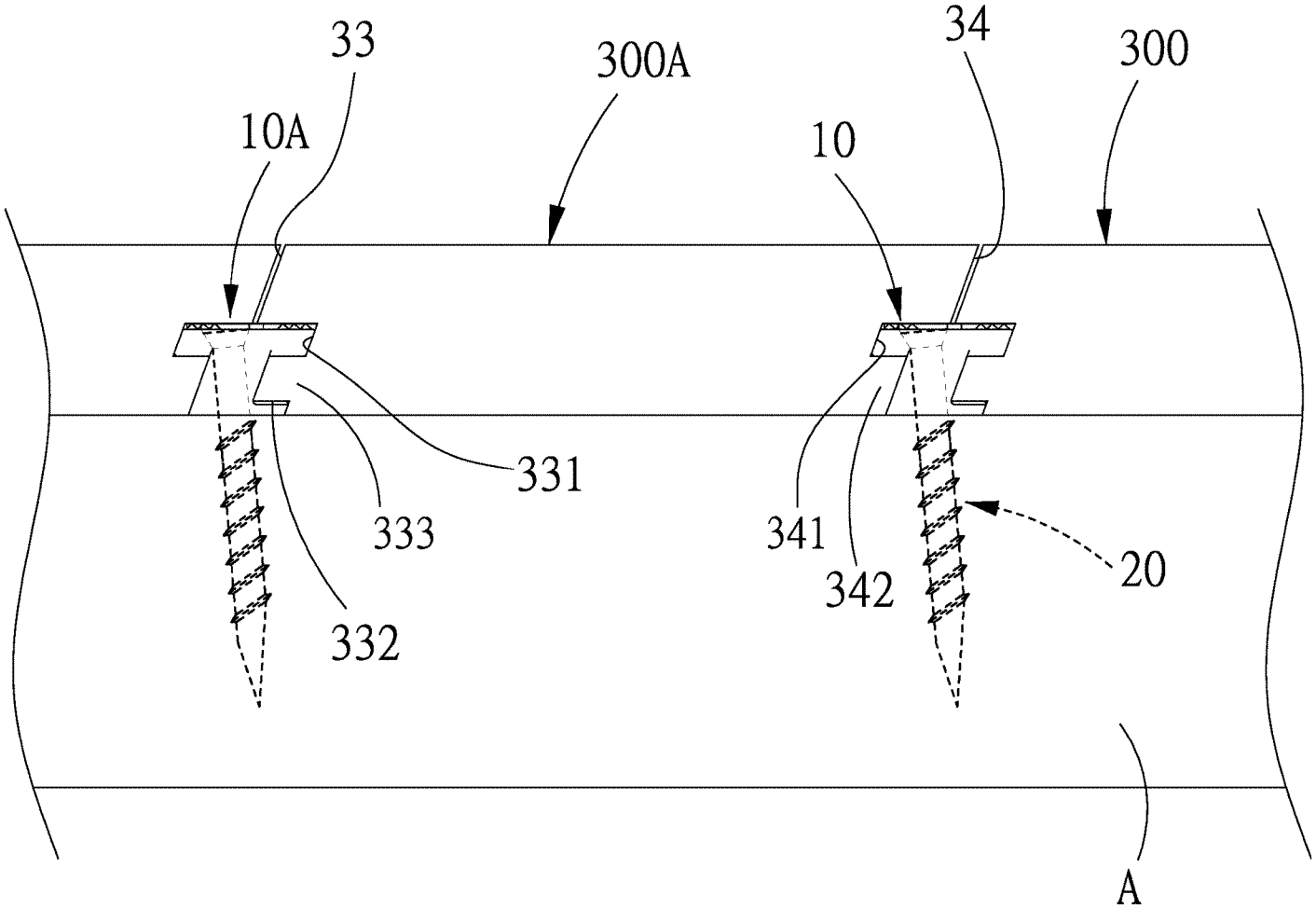
FIG. 2 is a front view, in an assembled form, showing the present invention in part.
Figure 3:
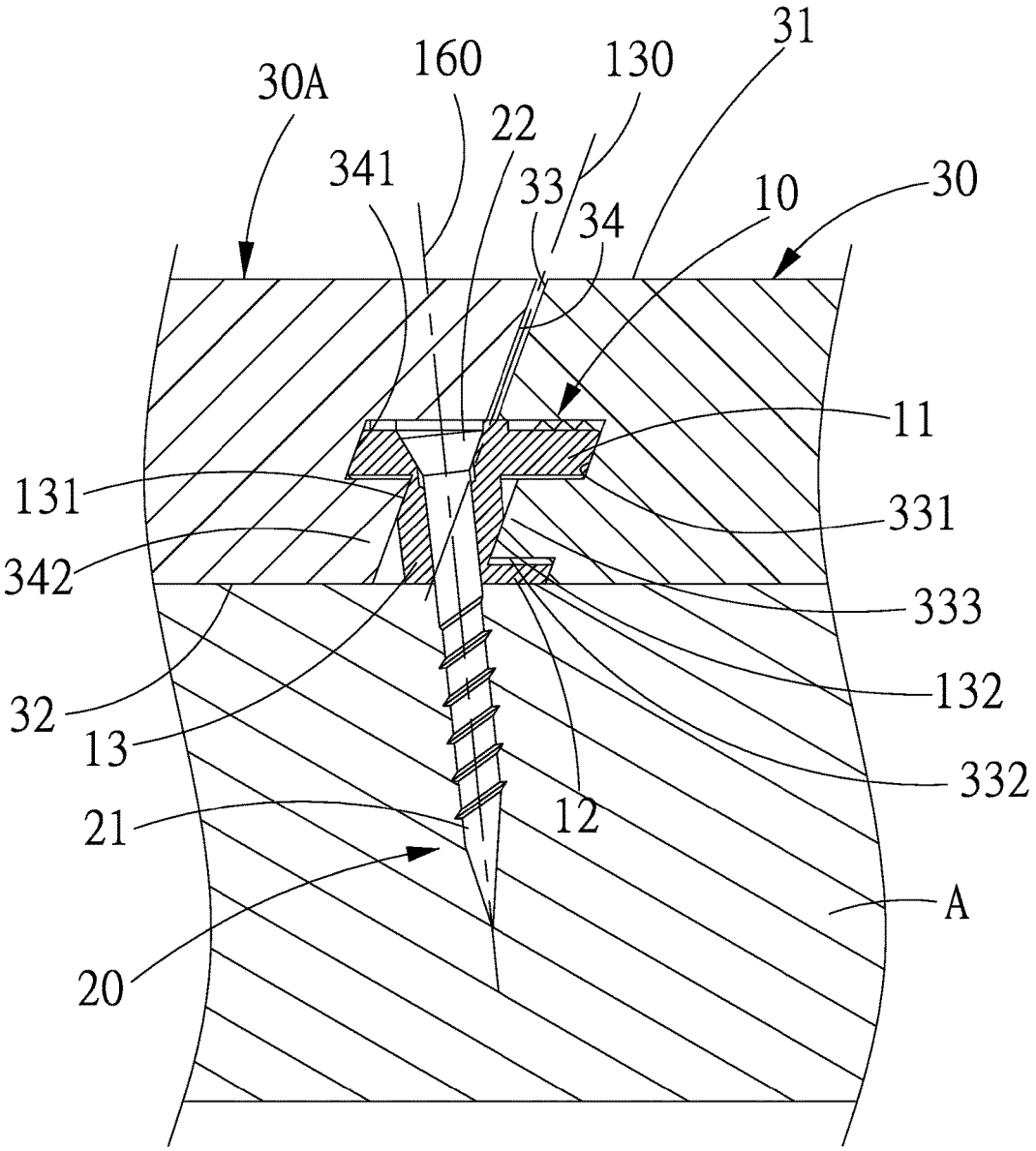
FIG. 3 is a cross-sectional view, in an assembled form, showing the present invention in part.

Referring to FIGS. 1-4, the present invention allows two boards 30, 300 to join on a right side of the connector 10, such that the right part of the upper plate 11, the lower plate 12, and the mortise trough 15 of the connector 10 are respectively fit to the first groove 331, the second groove 332, and the first tenon block 333 of the left-side assembling structure of each of the two boards 30, 300. Under such a condition, the countersunk cavity 162 is exposed at the left side of the two boards 30, 300, allowing the screw 20 to readily follow the path-following hole 16 to fasten, through self-tapping, the connector 10 to the beam A. During the process of fastening the screw 20 to the beam A, the path-following hole 16 and the screw 20 are allowed, through being mutually guided by each other, to push the connector 10 rightward for fine adjustment, so as to have the connector 10 and the two boards 30, 300 tightly engaging each other to be securely laid and mounted, as a unitary structure, on the beam A. Afterwards, the left part of the upper plate 11 and the engagement slot 14 of the connector 10 are respectively fit to the third groove 341 and the second tenon block 342 of the right-side assembling structure of each of another two boards 30A, 300A. As such, said another two boards 30A, 300A are positioned on and mounted to the beam A to allow the left-side inclined surfaces 33 of said another two boards 30A, 330A to be mounted to the beam A with another connector 10A as shown in FIG. 2, whereby leftward expansion through successively jointing or setting up desired systematic boards, with an inclined gap being present between the left-side inclined surface 33 and the right-side inclined surface 34 that are adjacent to each other and the screw heads 22 of the screws 20 being concealed under the right-side inclined surfaces 34 corresponding thereto, while the left-side inclined surfaces 33 matching and corresponding thereto provides a visual effect of compensation at the underside of the inclined gap.

Further, after the assembly operation of this invention, the first serration surfaces 122 and the second serration surfaces 113 that are arranged angularly alternate to each other could effectively enhance soundness of gripping between the connector 10 and the boards 30, 300, 30A, 300A in different directions, providing an effect of being unlikely to slide relative to each other.

Further, as shown in FIGS. 1 and 4, the present invention provides a first reference mark 114 on a right side portion of the top of the upper plate 11. The first reference mark 114 is in the form of a V-shaped groove formed at a location corresponding to a center of the mortise trough 15 for correcting the positions of the two boards 30, 300 that are jointed in a symmetric manner in the mortise trough 15. A second reference mark 115 is provided on a left side portion of the top of the upper plate 11. The second reference mark 115 is in the form of a V-shaped groove at a location corresponding to a center of the engagement slot 14 for correcting the positions of said another two boards 30A, 300A that are jointed in a symmetric manner in the engagement slot 14. This would greatly improve convenience of assembly and visual aesthetics of this invention.

Further, the aforementioned connector 10 is preferably provided with chamfering or made as a rounded section at each corner or angle in order to eliminate unnecessary interference in fitting or assembling the boards 30, 30A.

It could learn from the above description that according to this invention, every two adjacent boards 30, 30A are arranged as being mediated with the connector 10 as an intermediate medium therebetween to realize an expansive combination mounted to beams A, providing at least the following advantages:

(1) According to the present invention, the connector 10 is arranged for mounting on a beam A in a linearly slidable manner by means of the track channel 17 so as to set and keep the path-following hole 16 at a location corresponding to a center of the beam A, allowing a user to push and move the connector 10 with one hand to fit onto the board 30, while operating a screwdriver with another hand to drive the screw 20 to easily complete the construction operation. As such, frequently correcting the position of the connector that is required in the prior art techniques could be eliminated, making this invention more convenient and more efficient than the prior art. Further, such a structural arrangement also helps overcome undesired positional shifting of the connector often found in the prior art. Thus, the present invention would provide much better accuracy and better precision than the prior art.

(2) According to the present invention, the connector 10 is fit between two boards 30, 30A by means of the engagement slot 14 that includes the left taper surface 131 and the mortise trough 15 that includes the right taper surface 132 so that the capability of the connector 10 and the board 30, 30A for resisting and bearing vertical force and horizontal forces is enhanced to greatly improve overall structural strength.

Figure 7:
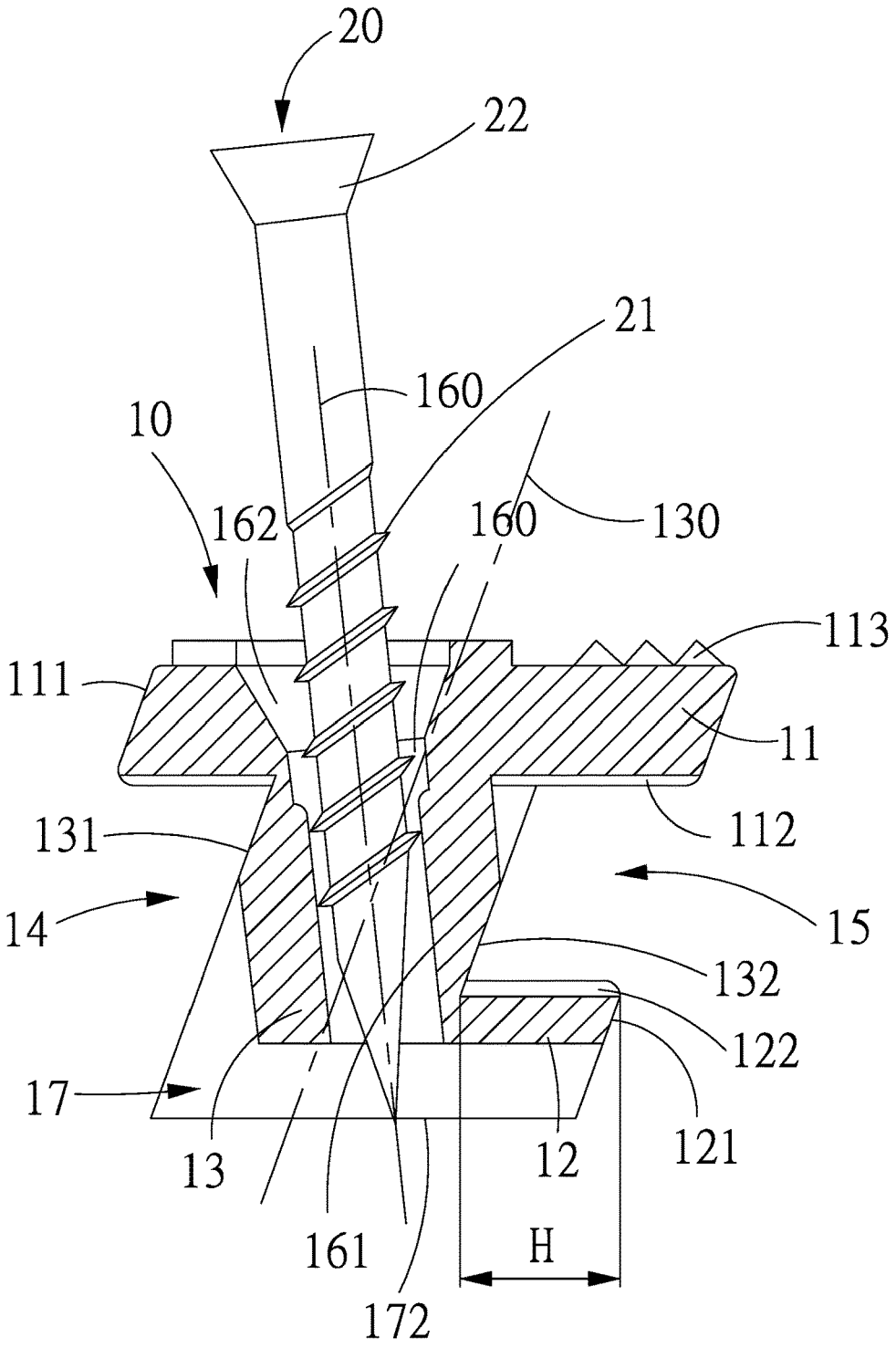
FIG. 7 is a vertical cross-sectional view showing the connector of the present invention in combination with a screw.
Figure 9:
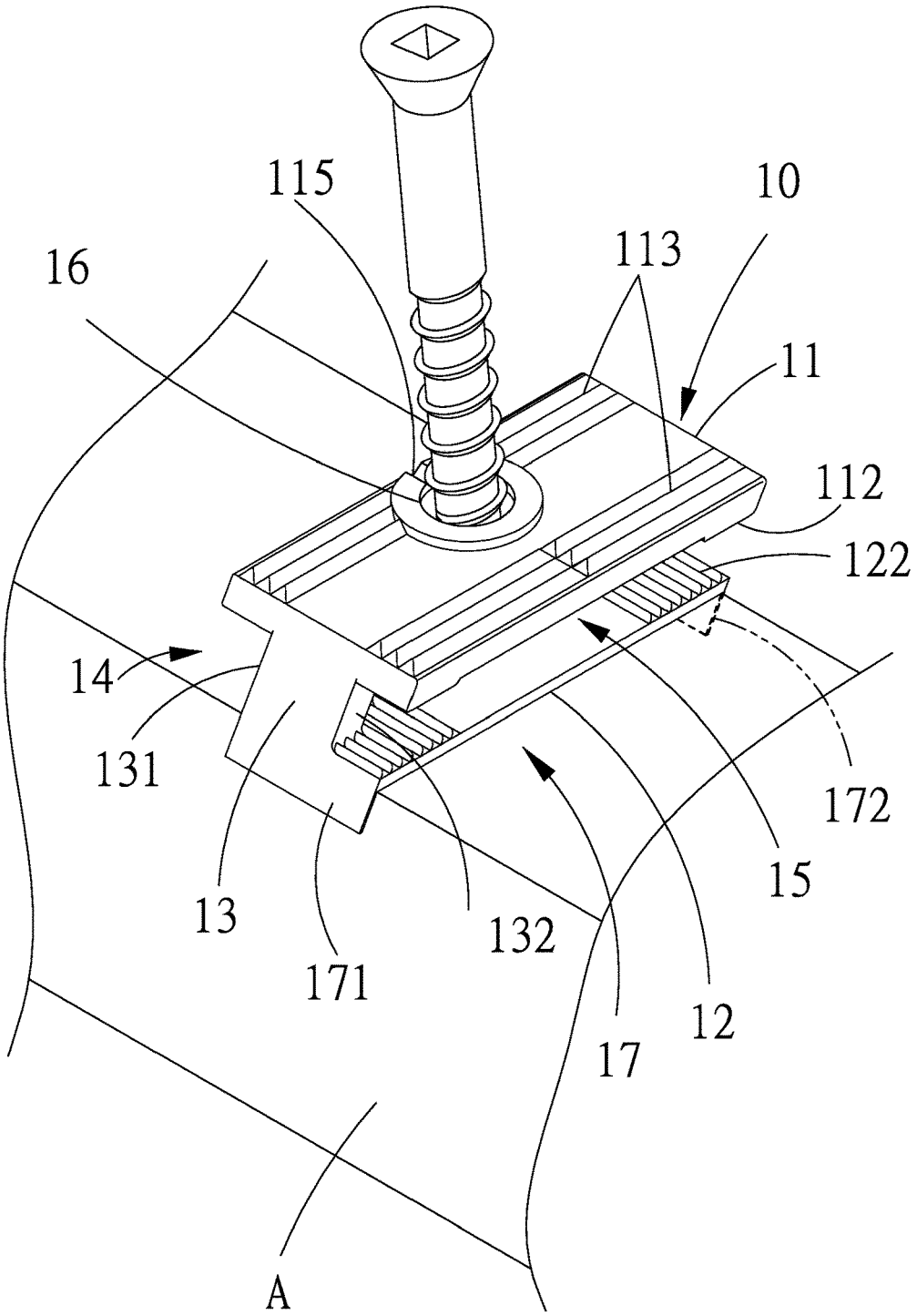
FIG. 9 is a schematic view illustrating adjustment conducted with sliding of the connector of the present invention and the screw.
Figure 10:
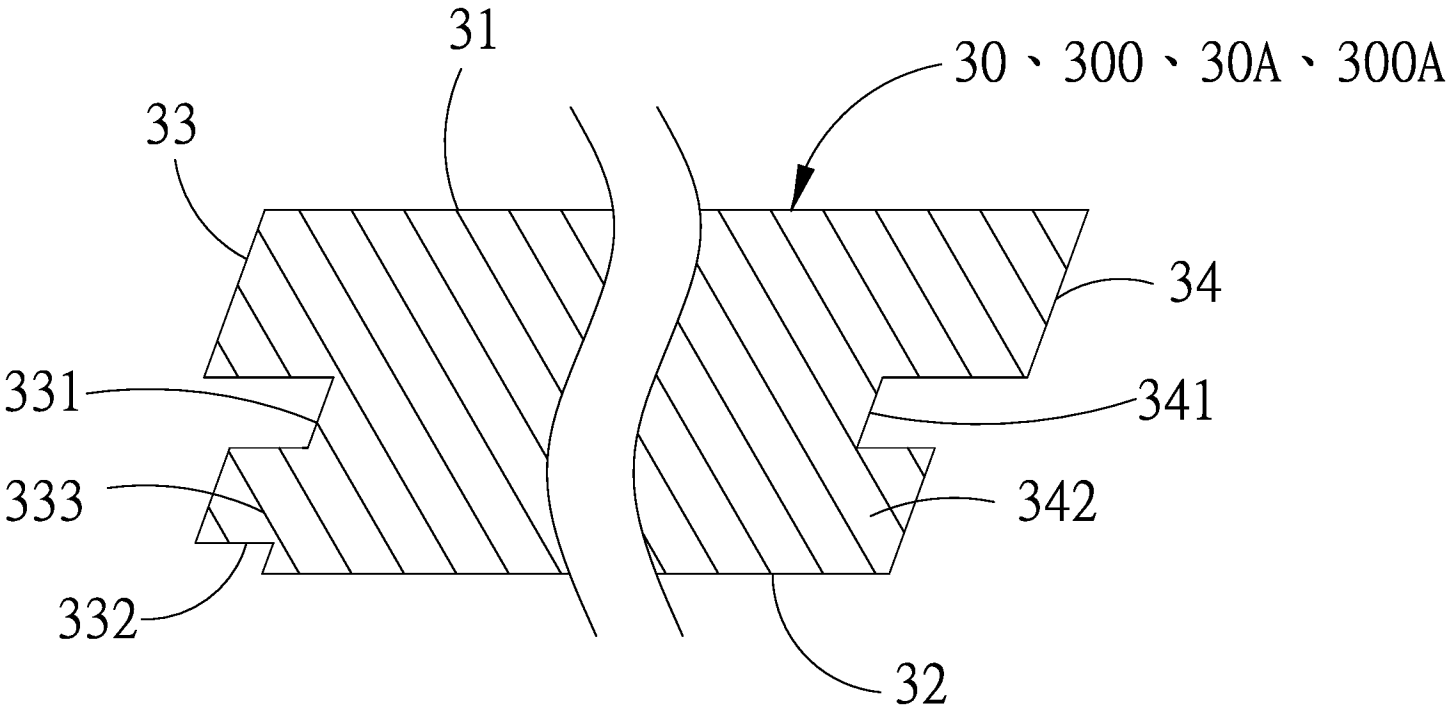
FIG. 10 is a cross-sectional view showing a board according to the present invention.

(3) According to the present invention, the inclined path-following hole 16 provides an effect of guiding and, as shown in FIGS. 7-9, includes clamp ribs 161 that provides a measure for coupling with the thread 21 of a screw 20 in advance so that the screw 20 and the connector 10 are kept together without ready separation from each other. More importantly, the clamp ribs 161 help guide the screw 20 to position in a correct direction, allowing a user to carry out fastening through screwing after purchase of this invention thereby providing an effect of making the assembling operation more efficiently and more conveniently and also helping prevent the boards 30, 30A from being damaged by undesired position shifting of screws.

(4) According to the present invention, the connector 10 makes use of the mortise trough 15 having a rightward facing opening and the path-following hole 16 that is arranged to have a center axis 160 thereof extending in a manner of being downward inclined toward and thus approaching the opening to have the screw 20, during a process of being fastened to a beam A, pushing the mortise trough 15 to more tightly fit over the first tenon block 33 of the board 30, thereby helping push the boards 30, 30A tightly against each other and eliminating occurrence of sliding and shifting, so that direct fastening could be achieved without hands holding the connector 10 and positioning can be made correct and efficient to allow the inclined gap between two boards 30, 30A to be greatly reduced to around 1.2 mm and effectively overcoming the deficiencies of the prior art.

(5) When the present invention is acted upon by an impact force or a jerk force, the contact area between the boards 30, 30A and the connector 10 includes interfaces between the right part of the upper plate 11 and the first groove 331, between the lower plate 12 and the second groove 332, between the mortise trough 15 and the first tenon block 333, between the left part of the upper plate 11 and the third groove 341, and between the engagement slot 14 and the second tenon block 342, so that the stability or soundness for the entire structure to support external force can be improved due to the increase of the contact area. In addition, with the arrangement that the screw 20 and the intermediate block 13 are set in an X-shaped configuration in mounting to a beam A, so that the stability or soundness of the structure of the connector 10 is enhanced and issues of noise and vibration occurring in the prior art could also be greatly improved.

(6) In the present invention, the upper plate 11 is provided, on the top thereof, with a first reference mark 114 and a second reference mark 115, which help correct, positionally, two boards 30, 300 for joining in symmetry in the mortise trough 15 or correct the other two boards 30A, 300A for joining in symmetry in the engagement slot 14, so that the boards 30, 300, 30A, 300A could transmit, in a homogeneous manner, forces to the beam A to prevent undesired positional shifting occurring between the boards 30, 300, 30A, 300A and the beam A.

(7) After completion of installation of the systematic board according to the present invention, since the screw heads 22 of screws 20 are concealed under the right-side inclined surface 34 and are thus not exposed as being located under a top opening of the inclined gap, so that there is no need to concern about conflict or inconsistency of the color of the screw heads 22 with respect to that of the systematic board. Thus, the screws 20 can be any standardized products, without the need for surface treatment of electroplating or blackening, so that the product is made more economic. Most importantly, since the inclined gap is generally located above the left-side inclined surface 33, in a top plan view, the left-side inclined surface 33 provides a visual effect of compensation or filling up the inclined gap, making it seemingly no gap at all and thus providing high product quality.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

I claim:

1. A connector of a systematic board of a building, the connector being structure to joint two boards to have the boards mounted to and lapping over a beam and comprising at least:

a path-following hole completely penetrating through the connector in an up-down direction; and a track channel, which has an opening facing downward and is formed in a bottom of the connector to allow the connector to slide along the beam in an axial direction by means of the track channel for limited movement for positional adjustment, the path-following hole being arranged to have a bottom opening located in a central portion of the track channel so as to allow a screw to extend through the path-following hole for fastening the connector to a center of the beam;

wherein the connector has one side that is formed with an engagement slot for jointing one of the boards, the connector having an opposite side that is formed with a mortise trough for jointing another one of the boards, the engagement slot and the mortise trough having axial directions that are arranged perpendicular to an axial direction of the track channel;

wherein the connector comprises an upper plate and an intermediate block extending downward from the upper plate, the engagement slot being defined between the intermediate block and a left part of the upper plate to have an opening facing leftward, the mortise trough being defined between the intermediate block and a right part of the upper plate to have an opening facing rightward, the path-following hole being formed in a top of the upper plate and extending downward to completely penetrating through the intermediate block;

wherein the intermediate block comprises a left taper surface and a right taper surface that are parallel to each other, the engagement slot being defined between the left taper surface and the left part of the upper plate to have the opening thereof facing leftward, the mortise trough being defined between the right taper surface and the right part of the upper plate to have the opening thereof facing rightward.

2. The connector of the systematic board of the building according to claim 1, wherein the track channel is defined between a front stop that extends downward from a front end of the bottom of the connector and a rear stop that extends downward from a rear end of the bottom of the connector, a spacing distance between the front stop and the rear stop being slightly greater than a width of the beam of the systematic board of the building.

3. The connector of the systematic board of the building according to claim 1, wherein the intermediate block has a center line extending from an upper right side to a lower left side and located between the left taper surface and the right taper surface, the path-following hole having a center axis that extends from an upper left side to a lower right side, so that the center line of the intermediate block and the center axis of the path-following hole are arranged to form an X-shaped configuration.

4. The connector of the systematic board of the building according to claim 1, wherein the intermediate block has a lower end to which a lower plate is mounted, the lower plate being parallel with the upper plate, so that the right taper surface, the right part of the upper plate, and the lower plate defining therebetween the mortise trough having the opening facing rightward, the lower plate having a width that is completely concealed under the upper plate.

5. The connector of the systematic board of the building according to claim 4, wherein the lower plate is concealed under the upper plate.

6. The connector of the systematic board of the building according to claim 4, wherein the lower plate comprises a first serration surface formed thereon and located in the mortise trough, the top of the upper plate being provided with a second serration surface, the first serration surface and the second serration surface being arranged to across each other.

7. The connector of the systematic board of the building according to claim 1, wherein the top of the upper plate is provided with a first reference mark on a right side portion thereof, the first reference mark being set at a location corresponding to a center of the mortise trough, the top of the upper plate being provided with a second reference mark on a left side portion thereof, the second reference mark being set at a location corresponding to a center of the engagement slot.

8. The connector of the systematic board of the building according to claim 1, wherein the path-following hole has an inside surface from which clamp ribs are raised, the path-following hole having an upper portion forming a countersunk cavity having a diameter diverging in an upward direction, the clamp ribs being structured to be in tight engagement with a thread of the screw, the countersunk cavity being sized to receive a screw head of the screw therein.

9. The connector of the systematic board of the building according to claim 1, wherein the connector has one side that is formed with an engagement slot for jointing one of the boards, the connector having an opposite side that is formed with a mortise trough for jointing another one of the boards, the engagement slot and the mortise trough having axial directions that are arranged perpendicular to an axial direction of the track channel.

10. The connector of the systematic board of the building according to claim 9, wherein the connector comprises an upper plate and an intermediate block extending downward from the upper plate, the engagement slot being defined between the intermediate block and a left part of the upper plate to have an opening facing leftward, the mortise trough being defined between the intermediate block and a right part of the upper plate to have an opening facing rightward, the path-following hole being formed in a top of the upper plate and extending downward to completely penetrating through the intermediate block.

11. The connector of the systematic board of the building according to claim 10, wherein the intermediate block comprises a left taper surface and a right taper surface that are parallel to each other, the engagement slot being defined between the left taper surface and the left part of the upper plate to have the opening thereof facing leftward, the mortise trough being defined between the right taper surface and the right part of the upper plate to have the opening thereof facing rightward.

12. The connector of the systematic board of the building according to claim 11, wherein the intermediate block has a center line extending from an upper right side to a lower left side and located between the left taper surface and the right taper surface, the path-following hole having a center axis that extends from an upper left side to a lower right side, so that the center line of the intermediate block and the center axis of the path-following hole are arranged to form an X-shaped configuration.

13. The connector of the systematic board of the building according to claim 11, wherein the intermediate block has a lower end to which a lower plate is mounted, the lower plate being parallel with the upper plate, so that the right taper surface, the right part of the upper plate, and the lower plate defining therebetween the mortise trough having the opening facing rightward, the lower plate having a width that is completely concealed under the upper plate.

14. The connector of the systematic board of the building according to claim 13, wherein the lower plate is concealed under the upper plate.

15. The connector of the systematic board of the building according to claim 13, wherein the lower plate comprises a first serration surface formed thereon and located in the mortise trough, the top of the upper plate being provided with a second serration surface, the first serration surface and the second serration surface being arranged to across each other.

16. The connector of the systematic board of the building according to claim 10, wherein the top of the upper plate is provided with a first reference mark on a right side portion thereof, the first reference mark being set at a location corresponding to a center of the mortise trough, the top of the upper plate being provided with a second reference mark on a left side portion thereof, the second reference mark being set at a location corresponding to a center of the engagement slot.

17. The connector of the systematic board of the building according to claim 1, wherein the path-following hole has an inside surface from which clamp ribs are raised, the path-following hole having an upper portion forming a countersunk cavity having a diameter diverging in an upward direction, the clamp ribs being structured to be in tight engagement with a thread of the screw, the countersunk cavity being sized to receive a screw head of the screw therein.

* * * * *